United States Patent [19]

Sweet

[11] Patent Number: 4,642,993

[45] Date of Patent: Feb. 17, 1987

[54] COMBUSTOR LINER WALL

[75] Inventor: Ervin J. Sweet, Trumbull, Conn.

[73] Assignee: Avco Corporation, Stratford, Conn.

[21] Appl. No.: 728,637

[22] Filed: Apr. 29, 1985

[51] Int. Cl.[4] ..... F02C 1/00; F02G 3/00; B21D 39/00

[52] U.S. Cl. ..... 60/752; 60/758; 428/593

[58] Field of Search ..... 60/752, 755, 756, 757, 60/758, 760; 428/593, 594

[56] References Cited

U.S. PATENT DOCUMENTS

| | | | |
|---|---|---|---|
| 2,919,549 | 1/1960 | Haworth et al. | 60/755 |
| 3,084,770 | 4/1963 | Wirsing, Jr. | 428/593 |
| 3,089,318 | 5/1963 | Hebeler | 428/593 |
| 3,485,043 | 12/1969 | Ehrich | 60/757 |
| 3,869,778 | 3/1975 | Yancey | 428/593 |
| 3,938,323 | 2/1976 | Quigg et al. | 60/752 |
| 4,104,874 | 8/1978 | Carvel et al. | 60/757 |
| 4,302,941 | 12/1981 | DuBell | 60/757 |
| 4,361,010 | 11/1982 | Tanrikut et al. | 60/757 |
| 4,384,020 | 5/1983 | Beggs et al. | 428/593 |
| 4,446,693 | 5/1984 | Pidcock et al. | 60/39.32 |
| 4,512,159 | 4/1985 | Memmen | 60/752 |

FOREIGN PATENT DOCUMENTS

| | | | |
|---|---|---|---|
| 652094 | 11/1962 | Canada | 60/752 |
| 1084809 | 1/1955 | France | 428/593 |
| 1300409 | 12/1972 | United Kingdom | 60/752 |

*Primary Examiner*—Louis J. Casaregola
*Assistant Examiner*—Timothy S. Thorpe
*Attorney, Agent, or Firm*—R. D. Gelling

[57] ABSTRACT

A combustor liner wall is provided with an interior wall, an exterior wall and a honeycomb structure disposed therebetween. The honeycomb structure is formed with generally radially aligned cells. The cells are constructed to define alternate array of gaps between the honeycomb structure and the interior and exterior walls, respectively. The cooling air thus undergoes repeated undulations and mixing as it flows through the liner wall.

15 Claims, 14 Drawing Figures

COMBUSTOR LINER WALL

BACKGROUND OF THE INVENTION

A gas turbine engine includes a compressor, a combustor and a turbine. Air is drawn into the compressor of the gas turbine engine. This air is compressed in the compressor and then is directed under pressure toward the combustor. Fuel also is directed into the combustor and is burned with the compressed air.

The combustion gases prouced in the combustor are directed at high speeds and under high pressure to the turbine. These gases impinge upon and rotate arrays of turbine blades, thereby performing work which operates the compressor and creates the thrust of the engine.

The compressed air approaching the combustor typically will have a temperature of 700° F. to 1200° F. On the other hand, the combustion gases produced in the combustor typically will be between 3500° and 4000° F.

There are significant performance advantages in maintaining the combustion gases at high temperatures. Conversely, there are certain performance penalties associated with the use of compressed air to perform cooling functions throughout the engine.

Despite the desirability of maintaining high operating temperatures and minimizing the amount of compressed air diverted to cooling functions, the wall of the combustor must be cooled to prevent structural damage. A small portion of this cooling is achieved by the relatively cool compressed air that travels adjacent the outer surface of the combustor prior to being mixed with the fuel. However, in most prior art engines, this external flow of compressed air can not achieve a significant amount of cooling of the combustor wall. More particularly, the velocity of the compressed air would have to be quite high to achieve any substantial external cooling of the combustor wall. If the size of the compressed air passage around the combustor liner was dimensioned to achieve higher velocities, it also would result in a substantial pressure drop along the length of that liner, thereby resulting in an inadequate pressure of the air flowing into the combustor near the end of that passage. Conversely, if the passage was dimensioned to have a minimum pressure drop, the velocity of the air would not be sufficient to achieve the required cooling.

In view of the above, most cooling of the combustor wall in the prior art engines has been achieved by directing a portion of the compressor discharge through the combustor wall in a way that will cool the wall. For example, annular arrays of small apertures were provided in the wall of prior art combustors to enable cooling to be carried out from the inner surface of the combustor. Specifically, the combustor wall would be provided with appropriate structures (e.g. splash rings) to create a thin film of cooling air adjacent the inner surface of the combustor. The effect of this thin film of cooling air would dissipate quickly. Consequently it was necessary to provide several successive arrays of cooling air apertures along the axial length of the combustor wall. The spacing between these cooling air apertures very depending upon the particular operating characteristics of the prior art engine. In most instances, these array of cooling air apertures would be spaced one to three inches from one another in an axial direction.

It has long been considered desirable to maximize the amount of combustor wall cooling that is carried out external to the actual combustion chamber. In many instances, this has been achieved by providing cooling air channels or grooves through the combustor wall. References which show this technology include: U.S. Pat. No. 4,292,810 which issued to Glenn on Oct. 6, 1981; U.S. Pat. No. 4,296,606 which issued to Reider on Oct. 27, 1981; U.S. Pat. No. 4,302,940 which issued to Meginnis on Dec. 1, 1981; and U.S. Pat. No. 4,315,406 which issued to Bhangu et al on Feb. 16, 1982. Briefly, these references all are directed to combustors having laminated walls with a plurality of circuitous paths extending therethrough. The various layers of the laminated wall each are provided with an array of grooves on one surface with a separate array of apertures extending through the layer and into the grooves. The layers are arranged such that the apertures and the grooves in one layer periodically communicate with the apertures and the grooves in an adjacent layer.

Different versions of the above described structures are shown in U.S. Pat. No. 4,292,810, which issued to Glenn on Oct. 6, 1981, U.S. Pat. No. 4,414,816 which issued to Craig et al on Nov. 15, 1983 and U.S. Pat. No. 4,480,436 which issued to Maclin on Nov. 6, 1984, all of which include spaced apart layers and internal baffles. The structures disclosed in these references would appear to rely more upon the convective film cooling inside the combustor than they would on conduction through the wall.

Most of the references cited above are believed to have many drawbacks. In particular, the structures include considerable mass and tend to be expensive to manufacture. Furthermore, the various prior art constructions are believed to yield somewhat uneven heat transfer characteristics across the combustor wall. Additionally, it is believed that in certain instances these prior art constructions will contribute to too great a pressure drop along the length of the passage through which the compressed air travels enroute to the combustor. This may result in an undesirable mixing pattern of compressed air and fuel within the combustor.

In view of the above described deficiencies of prior art combustor liners, it is an object of the subject invention to provide a combustor wall that easily and efficiently can be cooled by compressed air travelling through the combustor wall.

It is another object of the subject invention to provide a combustor wall that provides an efficient and desirable flow pattern of air through the combustor wall for cooling purposes.

It is an additional object of the subject invention to provide a combustor wall that can be manufactured easily and inexpensively.

It is a further object of the subject invention to provide a combustor wall that is lightweight but strong.

It is still another object of the subject invention to provide a combustor wall that can readily be subjected to quality control inspections at various stages during the manufacture of the combustor.

It is still an additional object of the subject invention to provide a combustor wall that achieves the desired velocity rates and pressure drops and proper mixing of air in the combustor.

Another object of the subject invention is to provide a combustor wall that can easily be provided with apertures through which air can be directed for proper mixing with the fuel.

SUMMARY OF THE INVENTION

The subject invention is directed to a combustor having a composite wall which includes an interior wall, an exterior wall spaced radially from the interior wall and a honeycomb structure disposed therebetween. The honeycomb structure defines a plurality of honeycomb cells, the respective axes of which are aligned in a generally radial direction. The honeycomb structure is formed to provide an array of gaps alternately disposed adjacent the interior and exterior walls. The cooling air will alternately undulate from an interior to an exterior direction in passing through the gaps. The term "exterior" as used herein is intended to describe a relative position with reference to the interior portion of the combustor or where the combustion process takes place. "Interior" in this context does not necessarily describe a frame of reference to the center line of the engine, since some combustors are annular.

The honeycomb structure of the combustor can be formed from a plurality of corrugated strips consecutively secured to one another to define the cells therebetween. Alternate strips can be disposed in contact with the interior wall of the combustor, but spaced from the interior wall thereof, while the remaining strips can be disposed adjacent the outer wall but spaced from the inner wall. This embodiment defines arrays of air flow paths which require the cooling air to alternately flow under and over adjacent corrugated strips thus effectively undulating in a radial direction. Additionally, air travelling through the combustor wall also will continuously undergo changes in axial and circumferential directions as the air passes from one cell to the next.

Preferably the honeycomb structure of the subject invention is fixedly secured to the inner wall of the combustor liner. This attachment can be achieved by welding or brazing with a wide fillet to contribute to heat transfer into the honeycomb structure.

The exterior wall of the combustor may merely function as a curtain to channelize the cooling air. Therefore the exterior wall can be formed from a very thin, lightweight material. Although the exterior wall should be in contact with portions of the honeycomb structure, it is not essential that the exterior wall be securely attached thereto. In one embodiment an interior wall with a honeycomb structure brazed or welded thereto can be secured and/or biased against an outer wall structure.

The honeycomb structure between the interior and exterior walls of the combustor liner can define honeycomb cells of any desired shape. A preferred shape, as described herein, is the standard honeycomb structure with hexagonal cells. However, sinusoidally varying cell walls or rectangular or octagonal cells also could be used.

The combustor wall preferably is formed from a plurality of generally annular sections of the above described composite honeycomb structure. Each annular section can be formed from unitary annular interior and exterior walls and unitary annular corrugated strips. Alternatively each annular section can be formed from a plurality of arc sections which are joined to form an annular section of the combustor wall. Adjacent annular sections preferably are radially offset from one another with downstream sections being disposed further outwardly in a radial direction relative to the adjacent upstream section. The upstream edge of each section will include an array of gaps adjacent the exterior liner wall, while the downstream edge will include gaps adjacent the interior wall of the liner. In embodiments having a honeycomb structure formed from corrugated strips, each section of the liner preferably will include an equal number of radially inward and radially outward corrugated strips. The first corrugated strip, or the strip lying at the upstream edge of each section will be disposed in contact with the interior wall of the combustor liner. It follows that the last corrugated strip, or the strip lying at the downstream end of each section, will be in contact with the exterior wall of the combustor liner.

The radial offset of adjacent sections of the combustor wall is sufficient to create a generally annular gap at the upstream end of each section. This gap will be disposed between the respective outer walls of adjacent liner sections. The radial dimension of this annular gap will be carefully selected in accordance with the cooling needs of the engine. Thus, the gap will enable a controlled amount of air to flow into a section of the combustor wall. This air will enter the appropriate section by flowing through the first circumferential array of exterior gaps. The air then will proceed to flow in an alternating upward and downward pattern by going alternately through the interior and exterior gaps respectively. The air will enter the combustor at the downstream end of the respective section. More particularly, the air will flow through the interior array of gaps adjacent the downstream end of the respective section and enter the combustor adjacent to the upstream edge of the interior wall of the next downstream section of combustor liner.

The structure described briefly above and in greater detail below is lightweight and easy to manufacture. Additionally, the precise cooling to be achieved by this structure can be carefully controlled through the selection of appropriate cell sizes. Specifically, the amounts of cooling is a function of the volume, velocity and pressure drop of the cooling air flowing through the honeycomb structure. This particular structure has been found effective in achieving required velocities and pressure drops with total liner thicknesses that are quite acceptable. Futhermore, the specific cooling characteristics can be carefully controlled by alternating the sizes of the honeycomb cells and the axial length of each section.

The subject honeycomb combustor liner has several other significant advantages. For example, as noted above, the exterior wall of the liner need not be securely attached to the exterior portions of the honeycomb structure. Rather, the exterior wall is merely wrapped around the honeycomb structure and secured to itself as one of the last steps of the manufacturing process. Thus, the entire honeycomb structure is readily apparent to view up until this last stage in the manufacturing process. This characteristic contributes to effective quality control checking throughout the manufacture of the subject combustor liner.

The combustor liner of the subject invention does not require any special manufacturing operations adjacent the larger inlets for mixing the compressed air with the fuel in the combustor. More particularly, an aperture can merely be formed in the subject combustor liner at any desired location. An appropriately dimensioned tube then can be inserted into the formed aperture and welded, brazed or otherwise secured in this position. The cooling air will effectively and efficiently flow around the tube extending through the subject combustor liner. An appropriate nozzle or the like can then be inserted into the tube to achieve the proper mixing of air and fuel in the combustor.

It should also be emphasized that the subject combustor liner achieves high velocities through the combustor liner and desirable pressure drops of cooling air. However, the volume of air flowing through the combustor liner can be carefully controlled so as to have little effect on the pressure drop in the primary flow of compressed air intended for mixture with the fuel as part of the combustion process in the engine.

DETAILED DESCRIPTION OF THE PREFERRED EMBODIMENT

Figure 1:
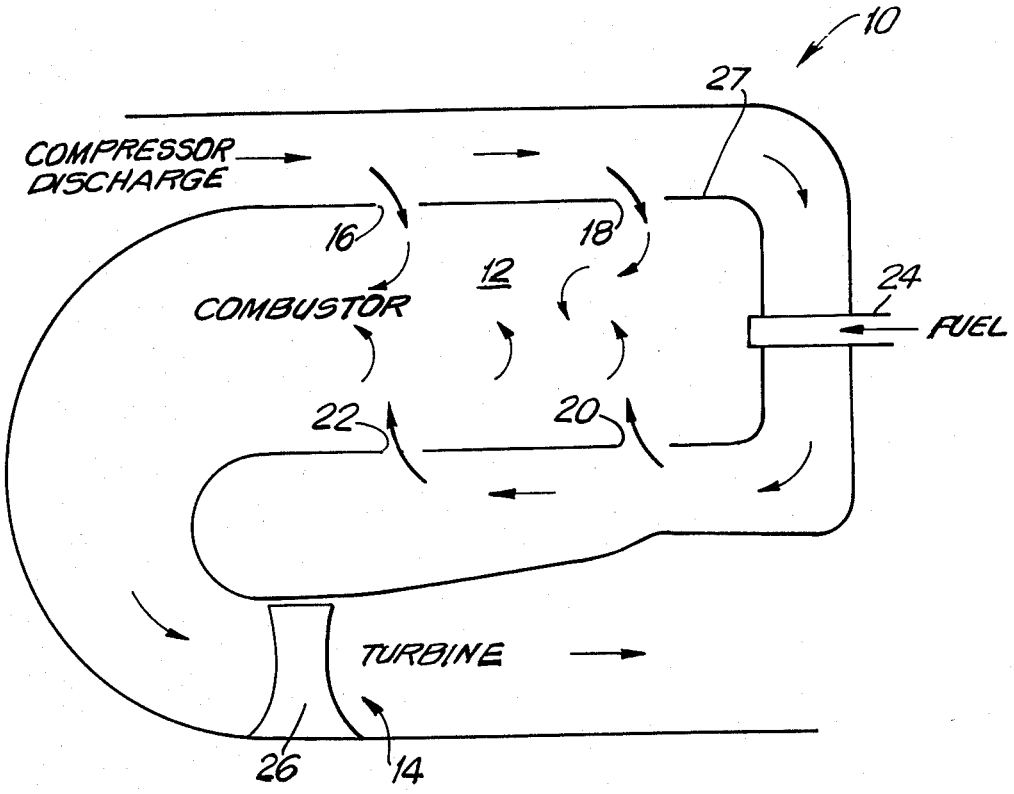
FIG. 1 is a schematic illustration of a portion of a combustor of a gas turbine engine.

A portion of a gas turbine engine is illustrated schematically in FIG. 1 and generally designated by the numeral 10. The gas turbine engine 10 includes a compressor (not shown), a combustor 12 and a turbine 14. The compressor is driven by the turbine 14 and is operative to draw air into the engine, compress the air and to direct the compressed air toward the combustor 12. The air discharged from the compressor is directed into the combustor 12 through apertures 16, 18, 20 and 22. Fuel also is directed into the combustor 12 through nozzle 24. The fuel is mixed and burned with the compressed air in the combustor 12. The gases produced by this combustion are directed toward the turbine 14 and impinge upon and rotate the turbine blades 26. Rotation of the turbine blades 26 provides the power for operating the compressor and provides the thrust for the engine 10.

As explained above, it is necessary to insure that the wall or liner 27 of the combustor 12 remains sufficiently cool to avoid structural damage. It also is necessary to insure that the air flowing from the compressor to the combustor 12 maintains sufficient pressure to achieve proper mixing of air and fuel in the combustor 12. Thus, the pressure drop of air flowing from the compressor to the combustor 12 can not be too great. As explained previously, this need to carefully control the pressure drop effectively precludes many methods of cooling the combustor liner 27.

Figure 2A:
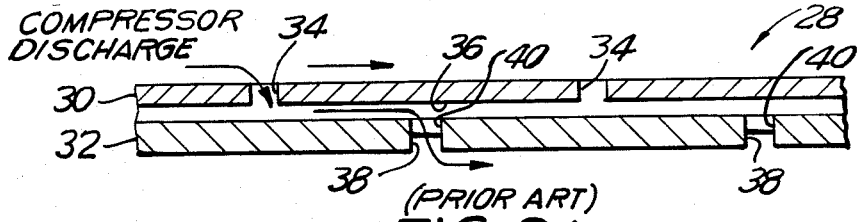
(PRIOR ART) FIG. 2A
FIG. 2A is a cross-sectional view of a portion of a first type of combustor liner of a prior art engine.

A portion of a prior art combustor liner is indicated generally by the numeral 28 of FIG. 2A. Briefly, the combustor liner 28 is a laminated structure formed from exterior layer 30 and interior layer 32. The exterior layer includes a plurality of through apertures 34 which connect with grooves 36 formed on the interior surface of layer 30. The interior layer 32 similarly includes through apertures 38 which connect to exterior facing grooves 40. The grooves 36 and 40 extend generally transverse to one another such that grooves 36 and 40 will periodically intersect to define a grid of intersecting grooves. Thus, as indicated by the arrows in FIG. 2A, compressed air can flow into apertures 34, through grooves 36, into grooves 40 and finally through apertures 38 to enter the combustor.

The combustor liner 28 illustrated in FIG. 2A is difficult and costly to manufacture. Additionally, it has been found to yield uneven cooling across the combustor liner 28. Furthermore, it has been found that special design considerations have to be made depending upon the placement of the apertures 16–22 through which the principal flow of compressed air will move for mixing with the fuel in the combustor.

Figure 2B:
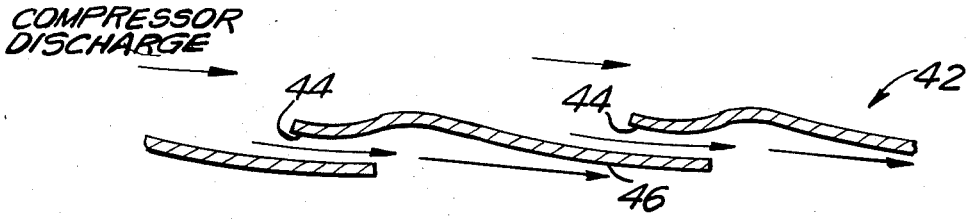
(PRIOR ART) FIG. 2B
FIG. 2B is a cross-sectional view of a portion of a second type of combustor liner on a prior art engine.

Another prior art combustor liner is illustrated schematically in FIG. 2B and is indicated generally by the numeral 42. The combustor liner 42 includes a plurality of apertures 44 extending through the combustor liner 42 and into the combustor. The apertures 44 are dimensioned to allow only a small amount of cooling air to enter the combustor therethrough. Additionally, the combustor liner 42 is formed such that the cooling air flowing through apertures 44 creates a film generally adjacent to the interior surface 46 of the combustor liner 42. This thin film cools the combustor liner 42 by convection.

A section of the combustor liner of the subject invention is indicated generally by the numeral 50 in FIGS. 3 through 8. The combustor liner 50 is effectively formed from a honeycomb structure 52 securely mounted to an interior wall 54. The honeycomb structure 50 is formed from a plurality of pair of undulated strips, with each pair comprising an interiorly disposed undulated strip 56 and an exteriorly disposed undulated strip 58. The interiorly disposed undulates strips 56 are securely affixed to the interior wall 54. The exteriorly disposed undulated strips 58, however, are spaced from the interior wall 54. More particularly, the exteriorly disposed undulated strips 58 are periodically secured to the interiorly disposed undulated strips 56 at their respective points of contact 60, as illustrated most clearly in FIGS. 3, 5 and 6. Additionally, the exteriorly disposed undulated strips 58 are periodically secured to the interiorly disposed strips 56 in the adjacent pair of strips at the respective points of contact 62.

The combustor liner 50 described above and illustrated most clearly in FIG. 3 thus defines a plurality of honeycomb cells 64. Two walls of each cell 64, however, will be spaced from the interior wall 54 thus defining interior gaps 66 through which cooling air may flow, as illustrated by the arrows in FIGS. 3, 5 and 6.

The combustor liner 50 also includes an exterior wall 68 which is mounted adjacent the exteriorly disposed undulated strips 58. Although the exterior wall 68 should be adjacent and in contact with the exteriorly disposed undulated strips 58, secure mounting thereto is not essential. Furthermore, the exterior wall 68 performs no significant structural function in the combustor liner 58 and thus can be formed from a lighter weight material then the interior wall 54. Specifically, the principal function of the exterior wall 68 is to define exterior gaps 70 extending between the exterior wall 68 and the respective edges of the interiorly disposed undulated strips 56. Thus, the combustor liner 50 provides a complex path for cooling air, wherein the cooling air will undergo a plurality of interior to exterior undulations, as the air sequentially flows through the exterior gaps 70 and interior gaps 66. These undulations, as illustrated most clearly in FIGS. 5 and 6 will principally be in an axial direction. However, as illustrated more clearly in FIG. 3, the cooling air will periodically divide in circumferential directions to create a flow pattern that is even more complex. The resulting complex flow pattern, as illustrated by the arrows in FIG. 3, results in a substantial amount of mixing and turbulance with a resultant degree of pressure drop.

As noted above, the respective undulated strips 56 and 58 are substantially identical to one another so as to define cells 64 when secured in pairs. Although the cells 64 are depicted as hexagonal in configuration, it is to be understood that other cell configurations are acceptable, and can easily be attained by forming the strips 56 and 58 with different patterns of undulations. For example, the strips 56 and 58 can be formed with substantially identical generally sinusoidal patterns of undulations.

Figure 3:
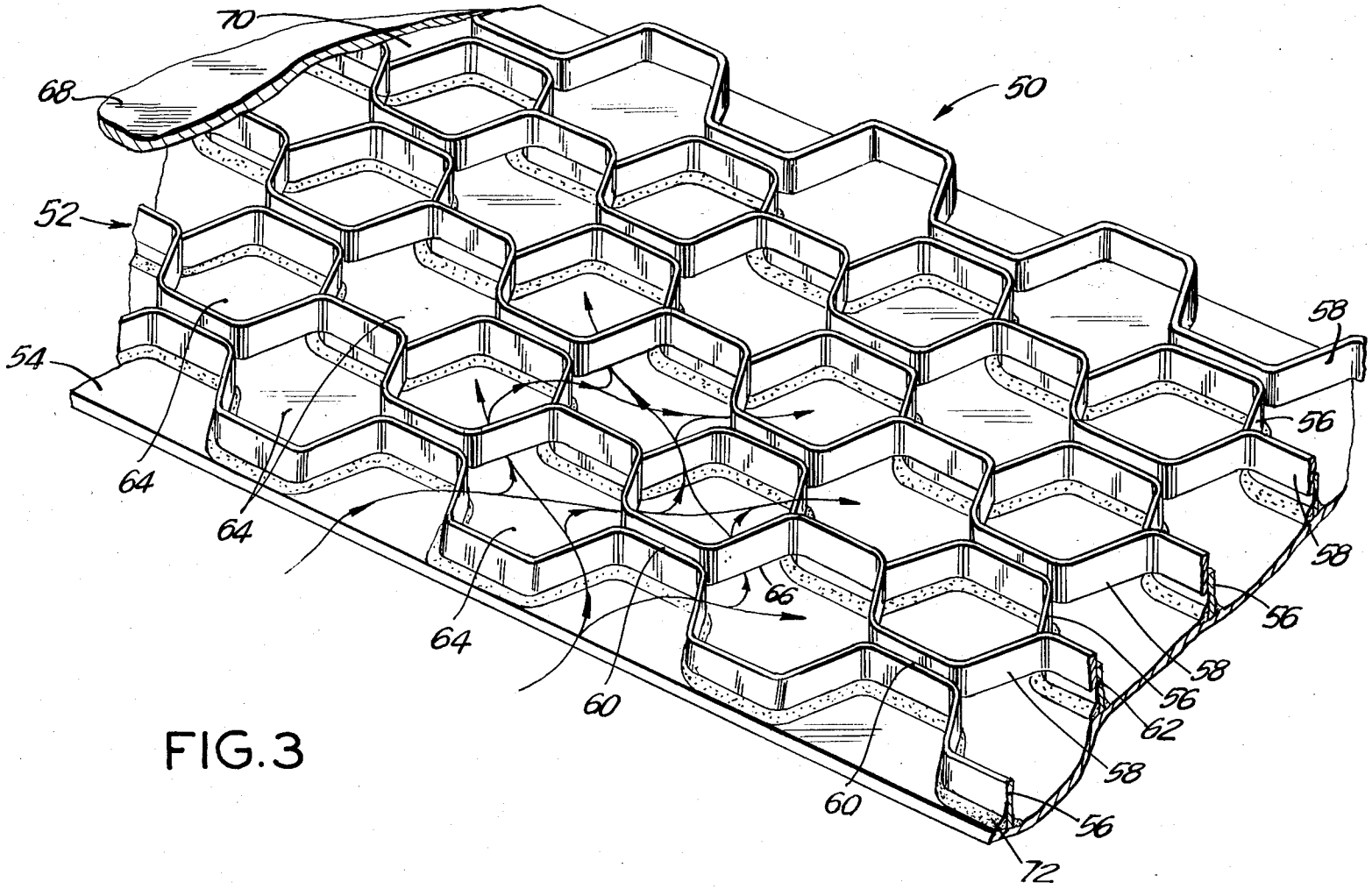
FIG. 3 is a perspective view of a portion of the combustor liner of the subject invention.
Figure 4:
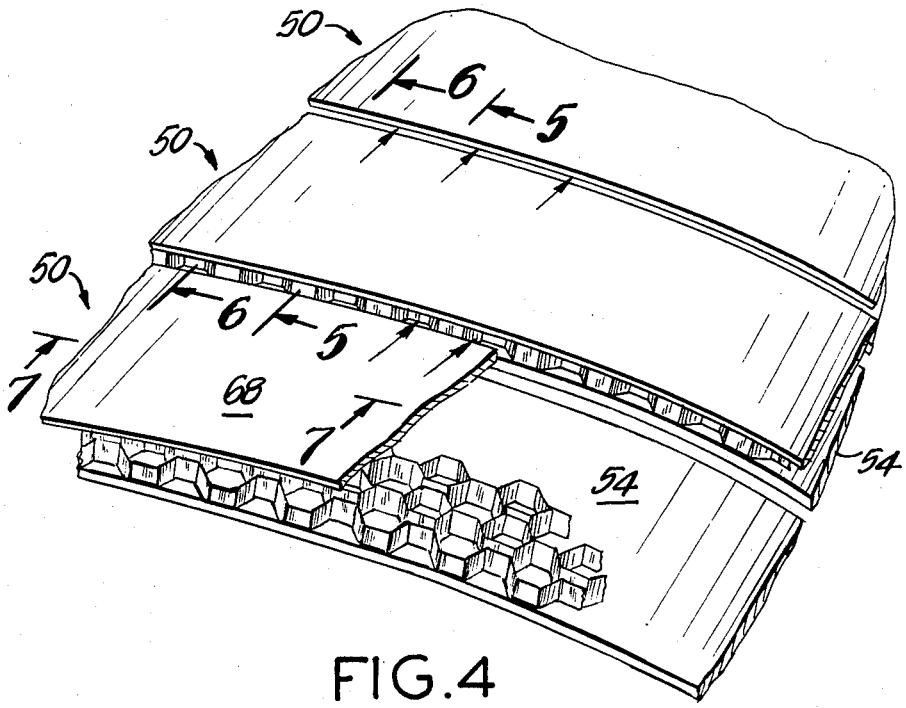
FIG. 4 is a perspective view of several sections of the combustor liner of the subject invention incorporated into a combustor.
Figure 5:
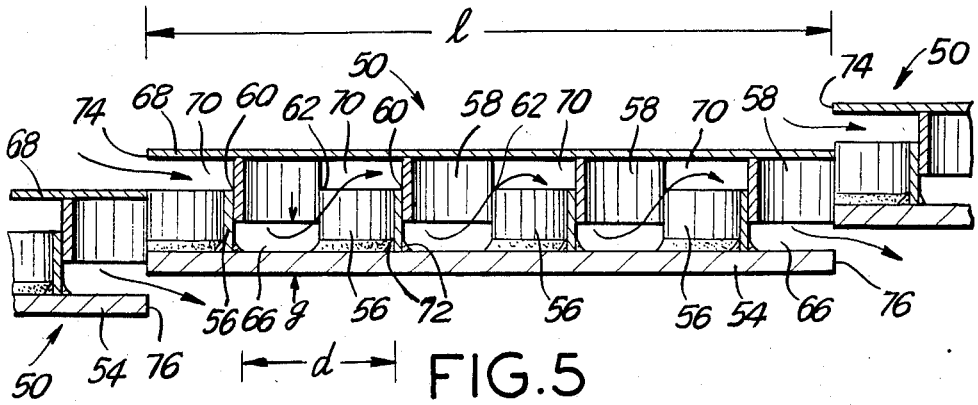
FIG. 5 is a cross-sectional view taken along line 5—5 in FIG. 4.
Figure 6:
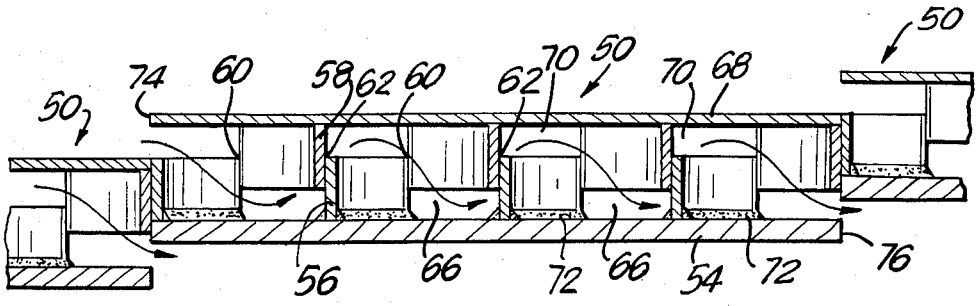
FIG. 6 is a cross-sectional view taken along line 6—6 in FIG. 4.
Figure 7:
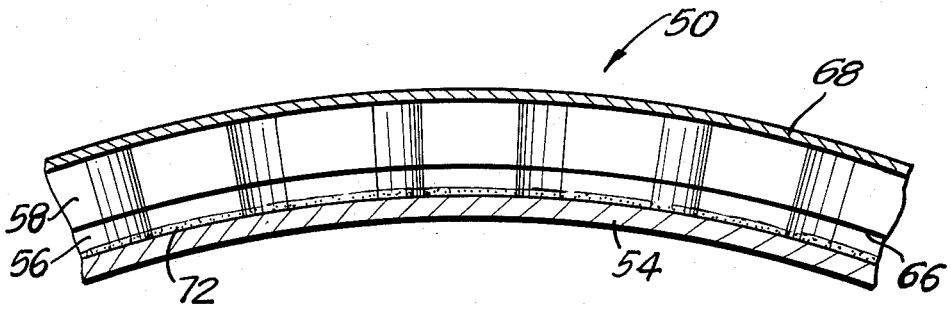
FIG. 7 is a cross-sectional view taken along line 7—7 in FIG. 4.

Preferred methods of construction also can be illustrated best with reference to FIG. 3. Specifically, the interiorly disposed undulated strips 56 are securely affixed to the interior wall 54 of combustor liner 50 while wall 54 is in a generally planar condition. Preferably the affixation of the interiorly disposed strips 56 to the interior wall 54 produces well defined fillets 72 at the respective points of contact. At this point during the construction, the respective lines of contact of interiorly disposed strips 56 and interior wall 54 are completely unobstructed. This high degree of accessibility facilitates the welding or brazing and subsequent quality control checking. After the interiorly disposed strips 56 are properly secured, the exteriorly disposed strips 58 are affixed to the interiorly disposed strips 56 at the respective points of contact 60 and 62. As noted above, this mounting of the exteriorly disposed strips 58 to interiorly disposed strips 56 provides interior gaps 66 between the inner wall 54 and exteriorly disposed strips 58. As an alternative to the above described sequence, the interiorly and exteriorly disposed strips 56 and 58 can be secured to one another prior to mounting on the inner wall 54.

After the secure mounting of interiorly disposed strips 56 to the inner wall 54 and the mounting of exteriorly disposed strips 56, the generally planar inner wall 54 may be bent into the appropriate annular configuration for mounting in the engine. The entire structure of interior wall 54 and strips 56 and 58 can still be readily observed to insure that the bending did not cause any structural damage. After the interior wall 54 is appropriately secured into its annular configuration, the exterior wall 68 can then be wrapped around the annular structure so as to contact the respective exteriorly disposed undulated strips 58. The exterior wall 68 is mounted in this position by merely securing the exterior wall 68 to itself to define a seam.

It should be noted that in certain environments, such as on very small engines, it may be desirable to form the honeycomb structure 52 from a plurality of annular seamless members. The annular corrugated members can then be secured to one another to form a tubular honeycomb structure which then can be slid over and welded to an annular interior wall.

The above described liner 50 preferably will define one axial section of a combustor wall. A plurality of sections of combustor liner 50 will be employed in the wall as illustrated most clearly in FIGS. 4 through 6. Each section of liner 50 will include pairs of interiorly disposed and exteriorly disposed undulated strips 56 and 58 such that the number of interiorly disposed strips 56 will equal the number of exteriorly disposed strips 58. Each liner section 50 will be constructed and disposed in the engine such that the upstream end 74, considered relative to the flow of compressed air, will be defined by an interiorly disposed undulated strip 56. It follows, therefore, that the downstream end 76 of the combustor liner section 50 will be defined by an exteriorly disposed strip 58. Additionally, each liner section 50 will be offset from the adjacent section 50 in a radial direction such that the exteriorly disposed gaps 70 at the upstream end 74 can accomodate a controlled amount of cooling air discharged from the compressor. Similarly, the offset illustrated most clearly in FIGS. 4 through 6 will insure that the interiorly disposed gap 66 at the downstream end 76 of each section 50 will enable cooling air to be dumped into the combustor to form hot side film cooling.

Figure 8:
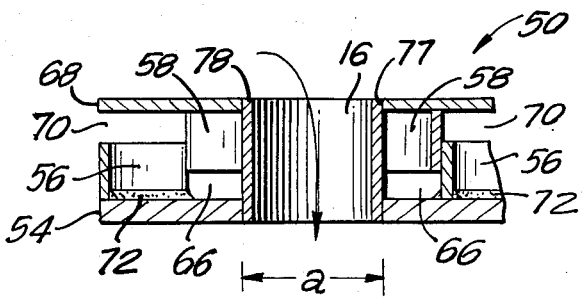
FIG. 8 is a cross-sectional view of a section of the combustor liner of the subject invention adjacent an aperture therein to enable air flow into the combustor for mixing with the fuel.

Turning to FIG. 8, the above described construction of the liner 50 readily enables the formation of apertures 16, 18, 20 or 22 to accomodate the principal flow of compressor discharge for mixing with fuel in the combustor 12. Specifically, an appropriately located and dimensioned aperture 77 may be formed through the liner 50. For example, the aperture 77 may readily be formed by drilling. A tube 78 having an outside diameter "a" substantially equal to the diameter of the aperture formed in liner 50 is inserted into the aperture 77 and secured thereto. It is unnecessary to carefully locate the aperture 77 relative to specific undulated strips 56 or 58. Furthermore, the existence of the aperture 77 and tube 78 will have little effect on the cooling of liner 50 because of the various optional paths available to the cooling air, as illustrated most clearly in FIG. 3.

Figure 9:
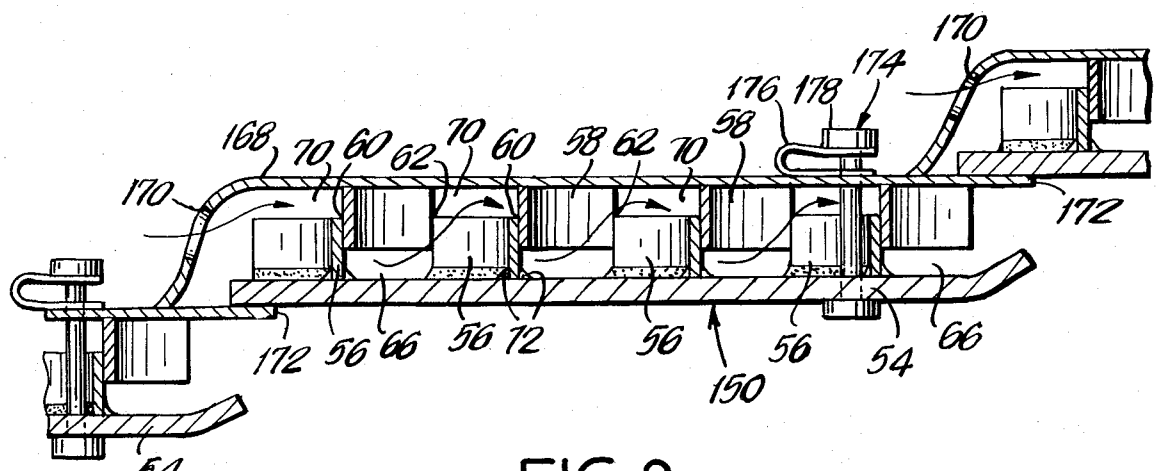
FIG. 9 is a cross-sectional view of an alternate combustor liner.

An alternative to the embodiment described above is illustrated in FIG. 9. This embodiment differs from the embodiment described above in that the combustor includes a structurally supportive exterior wall 168 against which a plurality of annular honey comb liner sections 150 are mounted. The structually supportive exterior wall 168 assumes varying radial dimensions along its axial length, with each successive downstream section being of slightly greater radius as illustrated in FIG. 9. The structually supportive outer wall 168 is provided with inlet apertures 170 at locations where the radial dimension of the outer wall 168 increases. The dimensions of the inlet apertures 170 are selected to enable a controlled volume of cooling air to enter the combustor liner wall. The structually supportive exterior wall 168 also includes interior support ledges 172.

The support ledges 172 contribute to the support of the honeycomb liner sections of 150 as explained below.

Honeycomb liner sections 150 include an interior wall 54 to which a plurality of undulated interiorly disposed strips 56 are secured in substantially the same manner as described for the like numbered parts utilized in the first embodiment. Also in a like manner, the exteriorly disposed undulated strips 58 are secured to the interiorly disposed undulated strips 56 at points of contact 60 to define a honeycomb structure affixed to the interior wall 54. The honeycomb liner sections 150 can be formed from a single planar honeycomb liner section that is bent into an annular configuration as explained above. Alternatively, each annular honeycomb liner section 150 can be formed from a plurality of arcuate sections that are joined to one another to form an annular honeycomb liner section 150.

The honeycomb liner sections 150 are secured against the structually supportive exterior wall 168. This mounting of the honeycomb liner section 150 to the exterior wall 168 is acheived by supporting one axial end of the annular honeycomb liner section 150 on the ledge 172. The opposed axial end of the honeycomb liner section 150 can be structually secured to the exterior wall 168 by bolts 174 and spring clips 176. More particularly the spring clips 176 cooperate with the head 178 of bolt 174 to hold the downstream axial end of each honeycomb liner section 150 against the structurally supportive exterior wall 168.

The precise performance of the liner 50 described in FIGS. 3–8 will depend upon the various dimensions of the members formed in the liner 50. It follows, that the various structural dimensions of the liner 50 will be selected in accordance with the precise performance characteristics of the engine. The specific parameters that may be varied in accordance with the demands of the engine, include the overall axial length of each liner section 50 as indicated by dimension "1" in FIG. 5. The distance across each cell is indicated by dimension "d" in FIG. 5. It follows that the number of cells in each liner stage 50 will be equal to the length "1" divided by the dimension of each cell "d" plus twice the thickness of the cell wall. Results of various analytical tests utilizing the liner 50 of the subject invention are illustrated graphically in FIGS. 10 through 13. Referring first to FIG. 9, the graph illustrates the relationship between cooling air temperature and gaps size "g". The relative dimensional parameters for the graphed lines 80 through 86 are indicated in Table 1 below.

TABLE 1

COMBUSTOR LINER SPECIFICATIONS FOR FIGS. 10 AND 11

| LINE NUMBER | CELL DIMENSION "d" | NUMBER OF CELLS | SECTION LENGTH "l" |
|---|---|---|---|
| 80/90 | 0.125 | 8 | 1.080 |
| 82/92 | 0.250 | 4 | 1.040 |
| 84/94 | 0.375 | 3 | 1.155 |
| 86/96 | 0.3125 | 3 | 0.967 |

Figure 10:
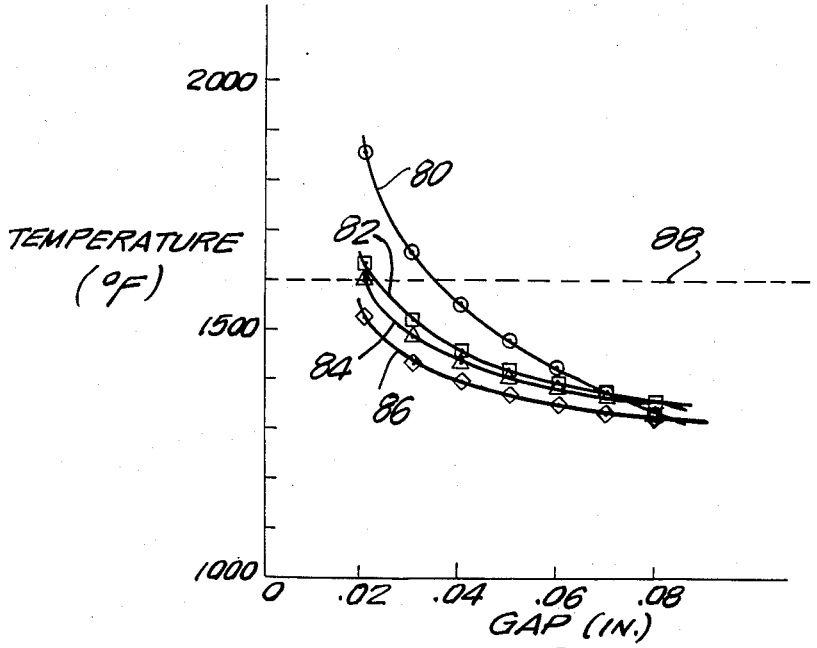
FIG. 10 is a graph showing the combustor wall temperature for a first set of operational and structural conditions.

The horizontal dashed line 88 in FIG. 10 corresponds to a wall temperature of 1600° F. which is generally accepted maximum temperature for a combustor liner wall. In this test the temperature of the combustion gases in the combustor was 3800° F. while the temperature of the compressor discharge gas was 734° F. Briefly, FIG. 10 shows that for various cell dimensions and gap sizes it is possible to maintain maximum wall temperatures well within acceptable limits.

Figure 11:
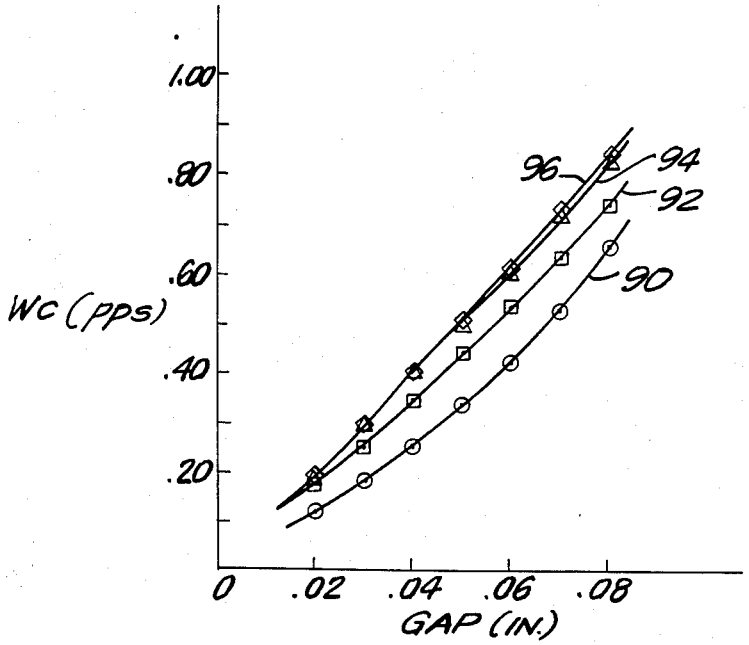
FIG. 11 is a graph showing cooling air flow rate for a first set of structural conditions.

FIG. 11 shows the relationship between cooling air flow rate and gap size for various constructions of liner 50. The graph lines 90 through 96 in FIG. 11 corresponds respectively to the liner constructions identified by lines 80 through 86 in FIG. 10 as presented in Table 1. Briefly, FIG. 11 indicates that the various wall cooling characteristics shown in FIG. 10 can be achieved with cooling air flow rates of less than 0.80 pps, which is well below the 1.16 pps that would be required for a standard thermal barrier coated louver operating at the same conditions.

Figure 12:
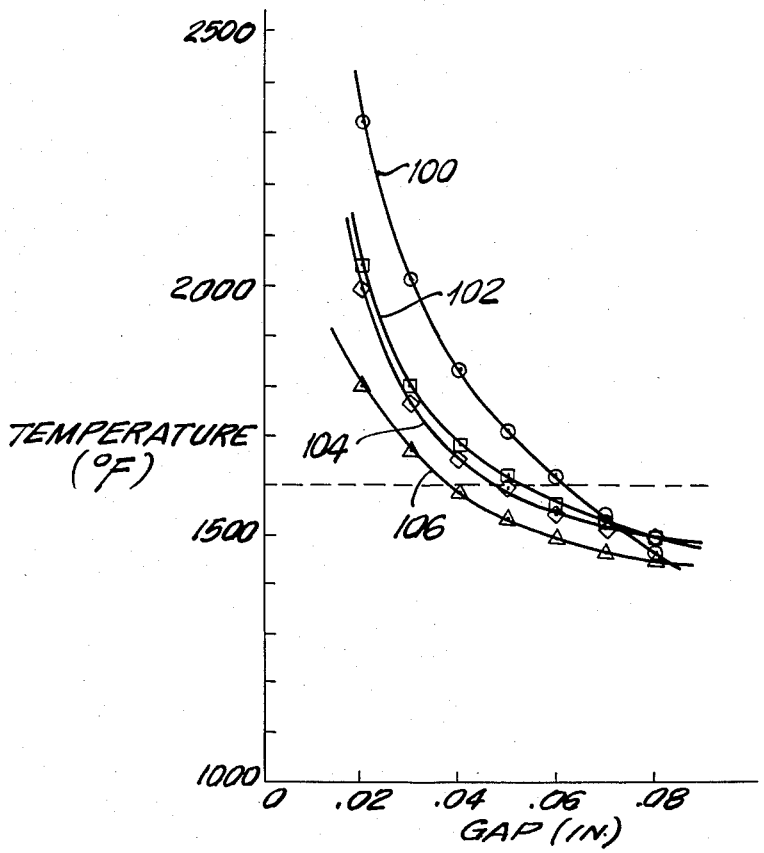
FIG. 12 is a graph showing the combustor wall temperature for a second set of operational and structural conditions.
Figure 13:
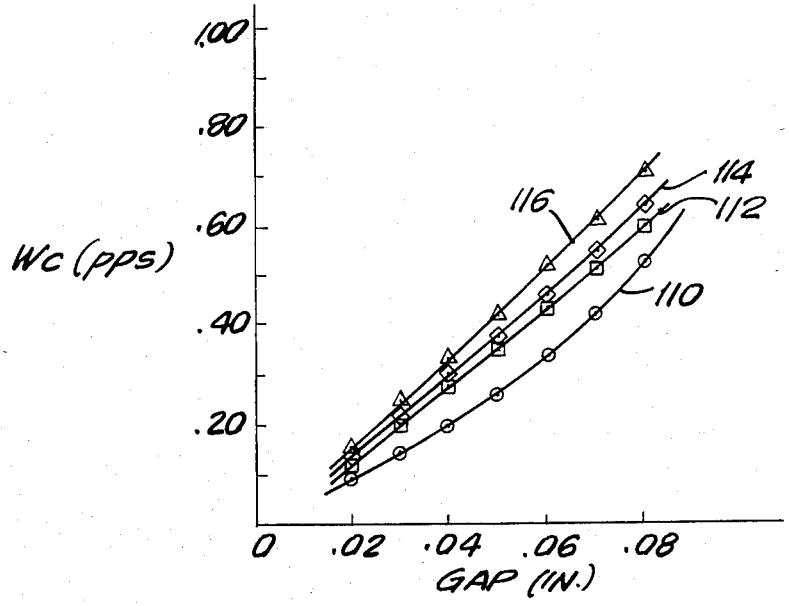
FIG. 13 is a graph showing cooling air flow rate for a second set of structural conditions.

FIGS. 12 and 13 are comperable to FIGS. 10 and 10 and reflect the same operating temperatures identified above. However, FIGS. 12 and 13 are based upon combustor liner stages 50 having longer lengths "1" and/or greater numbers of cells, as presented in Table 2 below.

TABLE 2

COMBUSTOR LINER SPECIFICATIONS FOR FIGS. 11 AND 12

| LINE NUMBER | CELL DIMENSION "d" | NUMBER OF CELLS | SECTION LENGTH "l" |
|---|---|---|---|
| 100/110 | 0.125 | 12 | 1.620 |
| 102/112 | 0.250 | 6 | 1.560 |
| 104/114 | 0.3125 | 5 | 1.613 |
| 106/116 | 0.375 | 4 | 1.540 |

Again, the graphs illustrate that even for combustor liner stages 50 of greater axial length "1" acceptable cooling can be achieved at flow rates considerably below those that would bered acceptable for a standard thermal barrier coated louver operating at the same conditions. Tests also showed that at higher operating temperatures, shorter section lengths may be required if the gap sizes remain in the range of 0.02–0.06. However, even at 4000° F. at the longer sections, acceptable cooling was obtained with the 0.08 inch gaps.

Based on the above, it can be seen that the particular pattern of turbulance of cooling air within the liner 50, as illustrated and described above, achieves a level of cooling that is at least as effective as the cooling achieved by prior art structures. Furthermore, as explained above, the particular unique construction described herein is strong, lightweight and inexpensive.

In summary, a combustor liner wall is provided with an interior wall, a honeycomb structure and an exterior wall. The honeycomb structure is securely mounted to the interior wall. The exterior wall in contact with the honeycomb structure but need not be securely attached thereto. The honeycomb structure is formed from a plurality of pairs of undulated strips with each pair including an interiorly disposed strip mounted to the interior wall and an exteriorly disposed strip adjacent the exterior wall. The interiorly disposed strips and the exteriorly disposed strips are radially offset from one another. Thus exterior gaps are defined intermediate the exterior wall and the interiorly disposed strips. Similarly interior gaps are defined between the interior wall and the exteriorly disposed strips. This unusual pattern causes the cooling air to sequentially travel through exterior to interior undulations as the cooled air flows in an axial direction. Additionally, there is a substantial amount of circumferential dividing and mixing of the cooling air. The combustor liner is formed from a plurality of stages with each stage having its exteriorly disposed gaps at its upstream end.

While the invention has been described relative to certain preferred embodiments, it is obvious that various modifications can be made therein without departing from the spirit of the invention which should be limited only by the scope of the appended claims.

What is claimed is:

1. A combustor liner wall comprising a generally annular interior wall, a generally annular exterior wall spaced radially with respect to a longitudinal axis of the combustor from the interior wall to form a generally annular space disposed between said walls, a honeycomb structure defined by a plurality of adjacent partitions extending radially with respect to the longiudinal axis of the combustor, said adjacent partitions arranged and constructed to form honeycomb cells within said annular space, said honeycomb structure further being formed such that portions of said structure adjacent each said cell are spaced radially from said exterior wall to define exterior gaps, and such that other portions thereof adjacent each said cell are spaced radially from said interior wall to define interior gaps, whereby cooling air can be directed alternately through the interior and exterior gaps to cool the combustor liner wall.

2. A combustor liner wall as in claim 1 wherein the honeycomb cell partitions are formed from a plurality of undulated strips.

3. A combustor liner wall as in claim 2 wherein said undulated strips define a plurality of pairs of undulated strips, each said pair including an interiorly disposed undulated strip and an exteriorly disposed undulated strip, said strips being generally annular in configuration with the interiorly disposed undulated strips being in contact with the interior wall of said liner and being spaced from the exterior wall thereof, and with the exteriorly disposed strips being in contact with the exterior wall of the liner but being spaced from the interior wall thereof.

4. A combustor liner wall as in claim 3 wherein the interiorly disposed undulated strips are securely attached to the interior wall.

5. A combustor liner wall as in claim 4 further including a plurality of metallic fillets securely attaching said interiorly disposed strips to said interior wall.

6. A combustor liner wall as in claim 5 wherein the fillets comprise weld or braze material.

7. A combustor liner wall as in claim 1 wherein the cells defined by said honeycomb structure are generally hexagonal.

8. A combustor liner wall formed from a plurality of combustor liner wall sections, each said section being generally annular and including:

a generally annular interior wall;

a generally annular exterior wall spaced radially from said interior wall; and a honeycomb structure disposed intermediate said interior and exterior walls, said honeycomb structure defined by a plurality of adjacent partitions extending radially with respect to a longitutinal axis of the combustor, exterior portions of said honeycomb structure adjacent each said cell being spaced from said exterior wall to define exterior gaps therebetween, interior portions of said honeycomb structure adjacent each said cell being spaced from said interior wall to define interior gaps therebetween, whereby said structure enables the flow of cooling air through the exterior and interior gaps.

9. A combustor liner wall as in claim 8 wherein each said section thereof is radially offset from the section adjacent thereto.

10. A combustor liner wall as in claim 8 wherein each said annular section includes an upstream end and an axially opposed downstream end, said honeycomb structure being formed to define a plurality of said exterior gaps adjacent said upstream end and a plurality of interior gaps adjacent said downstream end.

11. A combustor liner wall as in claim 8 wherein the exterior walls of adjacent sections are integral with one another.

12. A combustor liner wall as in claim 11 further including spring means for biasing the interior wall and the honeycomb structure against the exterior wall.

13. A combustor liner wall as in claim 12 wherein said exterior wall includes interiorly disposed ledges, each said interior wall being mounted on one said ledge.

14. A combustor liner wall as in claim 8 wherein said honeycomb structure is formed from a plurality of generally annular undulated strips, said plurality of strips defining a plurality of pairs of strips with each said pair including an interiorly disposed strip mounted to said interior wall and an exteriorly disposed strip disposed adjacent said exterior wall.

15. A combustor liner wall formed from a plurality of generally annular sections, each said section comprising:

a generally annular interior wall;

a honeycomb structure securely mounted to said interior wall, said honeycomb structure comprising a plurality of pairs of undulated strips with the strips in each said pair being secured to one another to define adjacent partitions extending radially with respect to a longitudinal axis of the combustor between adjacent pairs, and with said pairs being secured to one another to define generally aligned cells therebetween, each said pair including an interiorly disposed strip securely affixed to said interior wall and an exteriorly disposed strip spaced from said interior wall; and a generally annular exterior wall spaced from said interior wall and disposed in contact with the exteriorly disposed strips, said exterior wall being spaced from the interiorly disposed strips of said honeycomb structure.

* * * * *